US007449848B2

(12) United States Patent
Nishinosono

(10) Patent No.: US 7,449,848 B2
(45) Date of Patent: Nov. 11, 2008

(54) DRIVING CIRCUIT FOR COLD-CATHODE TUBE

(75) Inventor: Kazuo Nishinosono, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/267,567

(22) Filed: Nov. 4, 2005

(65) Prior Publication Data

US 2006/0091829 A1 May 4, 2006

(30) Foreign Application Priority Data

Nov. 4, 2004 (JP) ..... P2004-321039

(51) Int. Cl.
*H05B 37/00* (2006.01)

(52) U.S. Cl. ..... 315/312; 315/209 R

(58) Field of Classification Search ..... 315/274–287, 315/312–324, 246, 268, 209 R
See application file for complete search history.

(56) References Cited

U.S. PATENT DOCUMENTS

| | | | | |
|---|---|---|---|---|
| 2005/0099127 | A1* | 5/2005 | Chen et al. | 313/634 |
| 2005/0146291 | A1* | 7/2005 | Lee | 315/308 |
| 2006/0120109 | A1* | 6/2006 | Inoue et al. | 362/614 |

FOREIGN PATENT DOCUMENTS

| | | |
|---|---|---|
| JP | 59-130090 | 7/1984 |
| JP | 59-201398 | 11/1984 |
| JP | 8-45675 | 2/1996 |
| JP | 2000-262065 | 9/2000 |
| JP | 2002-164185 | 6/2002 |
| JP | 2002-175891 | 6/2002 |
| JP | 2002-278471 | 9/2002 |
| JP | 3101566 | 2/2004 |
| JP | 2004-281134 | 10/2004 |

OTHER PUBLICATIONS

Japanese Office Action for Japanese patent application No. 2004-321039, mailed Jun. 2, 2006, and English translation thereof, 4 pages.
Japanese Office Action for Japanese Application 2004-321039 mailed on Feb. 7, 2007 (5 pages).
Office Action dated Nov. 26, 2007 issued by the Japanese Patent Office in Application No. 2004-321039, 3 pages.

* cited by examiner

*Primary Examiner*—Trinh Vo Dinh
*Assistant Examiner*—Dieu Hien T Duong
(74) *Attorney, Agent, or Firm*—Osha • Liang LLP

(57) ABSTRACT

A cold-cathode tube driving circuit for driving a plurality of substantially-C-shaped cold-cathode tubes, includes: a first transformer 2 having primary windings which induce voltages, and secondary windings which apply voltages of opposite polarities (−V, +V) to respective ends of the respective substantially-C-shaped cold-cathode tubes; and a second transformer 3 having third and fourth primary windings which respectively induce voltages, and third and fourth secondary windings which apply voltages of opposite polarities (−V, +V) to respective ends of the respective substantially-C-shaped cold-cathode tubes. In the cold-cathode tube driving circuit, the first and second transformers 2, 3 apply an in-phase voltage to adjacent ends of the substantially-C-shaped cold-cathode tubes.

1 Claim, 2 Drawing Sheets

DRIVING CIRCUIT FOR COLD-CATHODE TUBE

BACKGROUND OF THE INVENTION

1. Field of the Invention

The present invention relates to a cold-cathode tube driving circuit, more particularly, to a driving circuit for driving a plurality of substantially-C-shaped cold-cathode tubes.

2. Description of the Related Art

JP-A-8-45675 describes a discharge lamp lighting apparatus of current feedback type having a switching circuit which causes the entirety or a portion of an electric current flowing through one or a plurality of discharge lamps to flow into an impedance device to thus change the impedance of the impedance device in accordance with the number of lighting circuits. According to the discharge lamp lighting apparatus, a tube current flowing through a single discharge lamp can be automatically maintained constant even when the number of discharge lamps or lighting circuits is arbitrarily changed within a preset range. Lighting of the discharge lamp is less susceptible to the influence of stray capacitance.

In JP-A-59-201398, an oscillation transformer having two secondary coils wound around a single iron core is used to light two discharge lamps connected in parallel, and is connected such that a d.c. current flows into the secondary coils in opposite directions, and first and second inductance coils are connected in opposite polarities. In the discharge lamp lighting apparatus, when one discharge lamp (the first discharge lamp) is first lighted, the current flows into the first inductance coil, whereby an induced voltage develops in the secondary inductance coil wound in opposite polarity. A high voltage is applied to the second discharge lamp by means of the induced voltage, to thus light the second discharge lamp without fail. Specifically, even when one discharge lamp has been lighted first, the voltage of the secondary coil used for supplying a voltage to another discharge lamp is prevented from dropping to the lamp voltage, thereby preventing failure to light a discharge lamp which is to be lighted later.

SUMMARY OF THE INVENTION

A cold-cathode tube of substantially-C-shaped type (hereinafter called "substantially-C-shaped cold-cathode tube") is frequently employed as a cold-cathode tube to be used for a backlight of a liquid crystal display device (LCD), which entails a necessity to ensure a maximum lighting area within a limited area. In the substantially-C-shaped cold-cathode tube, supply of a cathode ray to corners becomes difficult as compared with supply of the cathode ray to the other area, so that the corners become dark. For this reason, a method for double-feeding power from both ends of the substantially-C-shaped cold-cathode tube has been employed. In practice, a plurality of substantially-C-shaped cold-cathode tubes are arranged side by side; an in-phase voltage (+V) is applied to upper portions of the substantially-C-shaped cold-cathode tubes; and a voltage (−V) of opposite phase is applied to lower portions of the same. A lower portion of one cold-cathode tube is adjacent to an upper portion of the next cold-cathode tube, to thus generate large stray capacitance, and a large electric potential difference arises between these two portions. Accordingly, a leakage current flows by way of stray capacitance, to thus flicker lighting of the cold-cathode tube. In such a case, there may arise a problem of a flicker arising in a screen of a liquid crystal display device, or the like.

JP-A-8-45675 states that an electric current flowing into a plurality of discharge lamps is made uniform when a change has arisen in the number of the discharge lamps, but does not state a countermeasure against the influence of stray capacitance in adjacent portions of the plurality of discharge lamps. JP-A-59-201398 also fails to state the arrangement of discharge lamps, nor does it state a measure against the influence of stray capacitance when a plurality of discharge lamps are provided adjacent to each other.

The object of the present invention is to prevent occurrence of a flicker in an substantially-C-shaped cold-cathode tube even when power is fed to both sides of the substantially-C-shaped cold-cathode tube.

[Means for Solving the Problem]

A cold-cathode tube driving circuit according to a first aspect of the present invention is a cold-cathode tube driving circuit for driving a plurality of substantially-C-shaped cold-cathode tubes, including:

a first transformer having first and second primary windings which respectively induce voltages, and first and second secondary windings which apply voltages of opposite polarities to respective ends of the respective substantially-C-shaped cold-cathode tubes;

a second transformer having third and fourth primary windings which respectively induce voltages, and third and fourth secondary windings which apply voltages of opposite polarities to respective ends of the respective substantially-C-shaped cold-cathode tubes; and a driving circuit for driving the first and second transformers, wherein an in-phase voltage is supplied to adjacent ends of the substantially-C-shaped cold-cathode tubes by means of controlling a direction of an electric current flowing through the second and third primary windings.

In the cold-cathode tube driving circuit, when a plurality of substantially-C-shaped cold-cathode tubes are arranged side by side, an in-phase voltage is applied to adjacent end portions of the adjacent substantially-C-shaped cold-cathode tubes, and hence no potential difference arises between mutually-adjacent horizontal portions of the substantially-C-shaped cold-cathode tubes, and occurrence of a leakage current, which would otherwise arise by way of stray capacitance, can be prevented. As a result, occurrence of a flicker in lighting of the substantially-C-shaped cold-cathode tubes can be prevented. Moreover, when the substantially-C-shaped cold-cathode tubes are used for a backlight of a liquid crystal display device, occurrence of a flicker in the screen of the liquid crystal display device can be effectively prevented.

In the cold-cathode tube driving circuit, voltages applied to adjacent ends of the substantially-C-shaped cold-cathode tubes can be made in phase with each other without changing the winding direction of the primary and secondary windings, by means of controlling the direction of an electric current flowing through second and third primary windings which drive the adjacent ends of the substantially-C-shaped cold-cathode tubes. Consequently, the voltages applied to the adjacent ends of the substantially-C-shaped cold-cathode tubes can be brought in phase with each other without making modifications to the structure of the first and second transformers.

A cold-cathode tube driving circuit according to a second aspect of the present invention is a cold-cathode tube driving circuit for driving a plurality of substantially-C-shaped cold-cathode tubes, including a first transformer, a second transformer, and a driving circuit for driving the first and second transformers. The first transformer has first and second primary windings which respectively induce voltages, and first and second secondary windings which apply voltages of opposite polarities to respective ends of the respective substantially-C-shaped cold-cathode tubes. The second transformer has third and fourth primary windings which respectively induce voltages, and third and fourth secondary windings which apply voltages of opposite polarities to respective ends of the respective substantially-C-shaped cold-cathode tubes. The first and second transformers are characterized by applying an in-phase voltage to adjacent ends of the substantially-C-shaped cold-cathode tubes.

In the cold-cathode tube driving circuit, when a plurality of substantially-C-shaped cold-cathode tubes are arranged side by side, an in-phase voltage is applied to adjacent end-portions of the adjacent substantially-C-shaped cold-cathode tubes, and hence no potential difference arises between mutually-adjacent horizontal portions of the substantially-C-shaped cold-cathode tubes, and occurrence of a leakage current, which would otherwise arise by way of stray capacitance, can be prevented. As a result, occurrence of a flicker in lighting of the substantially-C-shaped cold-cathode tubes can be prevented. Moreover, when the substantially-C-shaped cold-cathode tubes are used for a backlight of a liquid crystal display device, occurrence of a flicker in the screen of the liquid crystal display device can be effectively prevented.

A cold-cathode tube driving circuit according to a third aspect of the present invention is based on the cold-cathode tube driving circuit according to the previous aspect and characterized in that an in-phase voltage is supplied to adjacent ends of the substantially-C-shaped cold-cathode tubes by means of controlling a direction in which an electric current is caused to flow through the second and third primary windings.

In the cold-cathode tube driving circuit, voltages applied to adjacent ends of the substantially-C-shaped cold-cathode tubes can be brought in phase with each other without changing the winding direction of the primary and secondary windings, by means of controlling the direction of an electric current flowing through second and third primary windings which drive the adjacent ends of the substantially-C-shaped cold-cathode tubes. Consequently, the voltages applied to the adjacent ends of the substantially-C-shaped cold-cathode tubes can be brought in phase with each other without making modifications to the structure of the first and second transformers.

DESCRIPTION OF THE PREFERRED EMBODIMENTS

Overall Configuration

Figure 1:
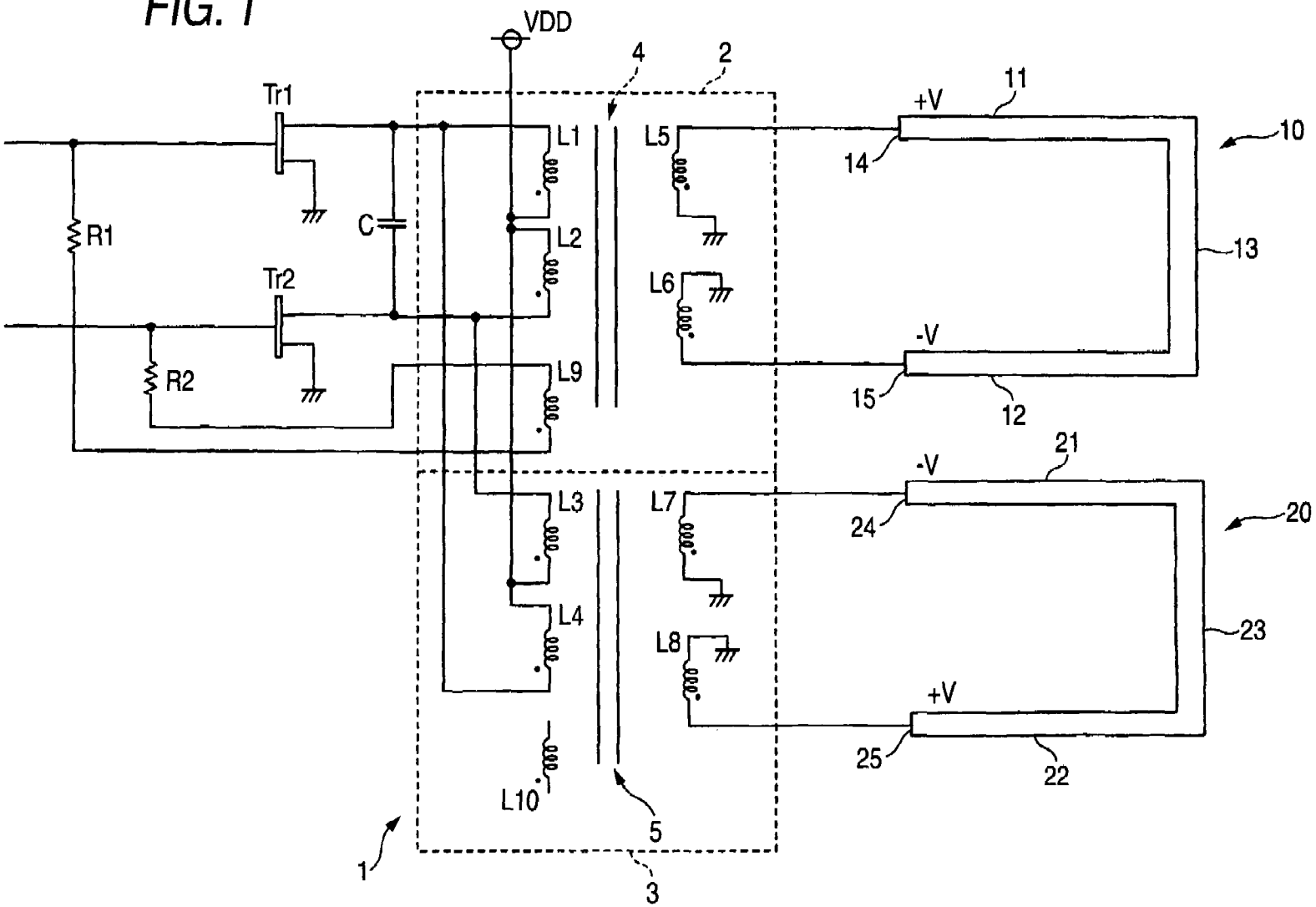
FIG. 1 is an electric circuit diagram of a cold-cathode tube driving circuit according to an embodiment of the present invention.

FIG. 1 is an electric circuit diagram of a cold-cathode tube driving circuit 1 according to an embodiment of the present invention.

The cold-cathode tube driving circuit 1 has transistors Tr1 and Tr2, a capacitor C, and oscillation transformers 2 and 3. The transistors Tr1 and Tr2 and the capacitor C function as a driving circuit for driving the transformers 2 and 3.

The transistors Tr1 and Tr2 are field-effect transistors (FETs), and drive the transformers 2 and 3 when being alternately turned on and off. Gates of the transistors Tr1 and Tr2 are connected to an unillustrated power source, and a switch used for activating the cold-cathode tube driving circuit 1 is interposed between the transistors Tr1, Tr2, and the power source. Specifically, at the time of activation of the cold-cathode tube driving circuit 1, the switch is turned on and, subsequently, turned off, thereby causing a circuit, which comprises the transistors Tr1, Tr2, the capacitor C, and the oscillation transformers 2, 3, to oscillate. By means of oscillation of the cold-cathode tube driving circuit 1, substantially-C-shaped cold-cathode tubes 10 and 20 connected to an output side of the cold-cathode tube driving circuit 1 are lighted. Drains of the transistors Tr1 and Tr2 are connected to respective sides of the capacitor C, as well as being connected to the primary sides of the oscillation transformers 2 and 3. The drain of the transistor Tr1 is connected to a coil end of a primary winding L1 of the oscillation transformer 2, and the drain of the transistor Tr2 is connected to a coil start of a primary winding L2 wound in the same direction in which the primary winding L1 is wound. The drain of the transistor Tr2 is connected to a coil end of a primary winding L3 of an oscillation transformer 3, and the drain of the transistor Tr1 is connected to a coil start of a primary winding L4 wound in the same direction in which the primary winding L3 is wound.

The oscillation transformer 2 has primary windings L1, L2, and L9; secondary windings L5 and L6; and a core 4 around which the primary windings L1, L2, and L9 and the secondary windings L5 and L6 are wound. The primary windings L1, L2, and L9 and the secondary windings L5 and L6 are wound in the same direction. The coil end of the primary winding L1 is connected to the drain of the transistor Tr1; the coil start of the primary winding L2 is connected to the drain of the transistor Tr2; and the coil start of the primary winding L1 and the coil end of the primary winding L2 are connected to a power source VDD. The coil start of the primary winding L9 is connected to the gate of the transistor Tr1 by way of a resistor R1, and the coil end of the primary winding L9 is connected to the gate of the transistor Tr2 by way of a resistor R2. The coil start of the secondary winding L5 is connected to the ground, and the coil end of the secondary winding L5 is connected to an upper end portion 14 of the substantially-C-shaped cold-cathode tube 10. The coil start of the secondary winding L6 is connected to a lower end portion 15 of the substantially-C-shaped cold-cathode tube 10, and the coil end of the secondary winding L6 is connected to the ground.

The oscillation transformer 3 has primary windings L3, L4, and L10; secondary windings L7 and L8; and a core 5 around which the primary windings L3, L4, and L10 and the secondary windings L7 and L8 are wound. The primary windings L3, L4, L10 and the secondary windings L7 and L8 are wound in the same direction. The coil end of the primary winding L3 is connected to the drain of the transistor Tr2; the coil start of the primary winding L4 is connected to the drain of the transistor Tr1; and the coil start of the primary winding L3 and the wind end of the primary winding L4 are connected to the power source VDD. In the above connection, an electric current flows in opposite directions in the primary windings L2 and L3. Consequently, voltages of opposite polarities are induced in the primary windings L2 and L3, and voltages of opposite polarities are induced in the secondary windings L6 and L7, as well. The primary winding L10 is not used and is opened. The coil start of the secondary winding L7 is connected to the ground, and the coil end of the secondary winding L7 is connected to an upper end portion 24 of the substantially-C-shaped cold-cathode tube 20. The coil start of the secondary winding L8 is connected to a lower end portion 25 of the substantially-C-shaped cold-cathode tube 20, and the coil end of the secondary winding L8 is connected to the ground.

The cold-cathode tubes 10 and 20, which are shown in FIG. 1, are mounted on, e.g., a liquid crystal display device and used as backlights. The cold-cathode tubes 10 and 20 are substantially-C-shaped cold-cathode tubes. When the cold-cathode tubes are mounted on a liquid crystal display device, a plurality of cold-cathode tubes are usually arranged as shown in FIG. 1. Here is described a case where the cold-cathode tubes 10 and 20 are arranged vertically. However, the present embodiment can be applied similarly to a case where the cold-cathode tubes 10 and 20 are arranged side by side; namely, where the cold-cathode tubes 10 and 20 shown in FIG. 1 are rotated clockwise or counterclockwise through 90°, so long as a mutual positional relationship between the cold-cathode tubes 10 and 20 is maintained.

The cold-cathode tube 10 has horizontal portions 11 and 12, and a vertical portion 13 for coupling together the horizontal portions 11 and 12. The coil end of the secondary winding L5 of the oscillation transformer 2 is connected to the upper end portion 14 of the cold-cathode tube 10. The coil start of the secondary winding L6 of the oscillation transformer 3 is connected to the lower end portion 15 of the cold-cathode tube 10.

The cold-cathode tube 20 has horizontal portions 21 and 22, and a vertical portion 23 coupling together the horizontal portions 21 and 22. The coil end of the secondary winding L7 of the oscillation transformer 3 is connected to the upper end portion 24 of the cold-cathode tube 20. The coil start of the secondary winding L8 of the oscillation transformer 3 is connected to the lower end portion 25 of the cold-cathode tube 20.

(2) Working-Effects

In the cold-cathode tube driving circuit 1 shown in FIG. 1, the transistors Tr1 and Tr2 are alternately turned on and off, to thus drive the oscillation transformers 2 and 3. In the oscillation transformers 2 and 3, the voltages of opposite polarities are induced in the primary windings L2 and L3, and the voltages of opposite polarities are induced in the secondary windings L6 and L7, as well. The coil start of the secondary winding L6 is connected to the lower end portion 15 of the cold-cathode tube 10, whereas the coil end of the secondary winding L7 is connected to the upper end portion 24 of the cold-cathode tube 20. Specifically, the voltages of opposite polarities are induced in the secondary windings L6 and L7, whilst the coil start of the secondary winding L6 and the coil end of the secondary winding L7 become in phase with each other (−V). Consequently, the lower end portion 15 of the cold-cathode tube 10 and the upper end portion 24 of the cold-cathode tube 20 are in phase with each other (−V), and the horizontal portion 12 of the cold-cathode tube 10 and the horizontal portion 21 of the cold-cathode tube 20 are also in phase with each other. Meanwhile, the voltages of opposite polarities are induced in the primary windings L1 and L4, and the voltages of opposite polarities are induced in the secondary windings L5 and L8. Now, the coil end of the secondary winding L5 is connected to the upper end portion 14 of the cold-cathode tube 10, whilst the coil start of the secondary winding L8 is connected to the lower end portion 25 of the cold-cathode tube 20. Specifically, the voltages of opposite polarities are induced in the secondary windings L5 and L8, but the coil end of the secondary winding L5 and the coil end of the secondary winding L8 become in phase with each other. The voltage appearing in the coil end of the secondary winding L5 and the voltage appearing in the coil end of the secondary winding L8 are +V and opposite in polarity to the voltage appearing in the coil start of the secondary winding L6 and the voltage appearing in the coil end of the secondary winding L7.

As mentioned above, according to the cold-cathode tube driving circuit 1, the voltages appearing in the adjacent horizontal portions 12 and 21 of the substantially-C-shaped cold-cathode tubes 10 and 20 are equal in phase to each other, and no potential difference arises between the horizontal portions 12 and 21.

Figure 2:
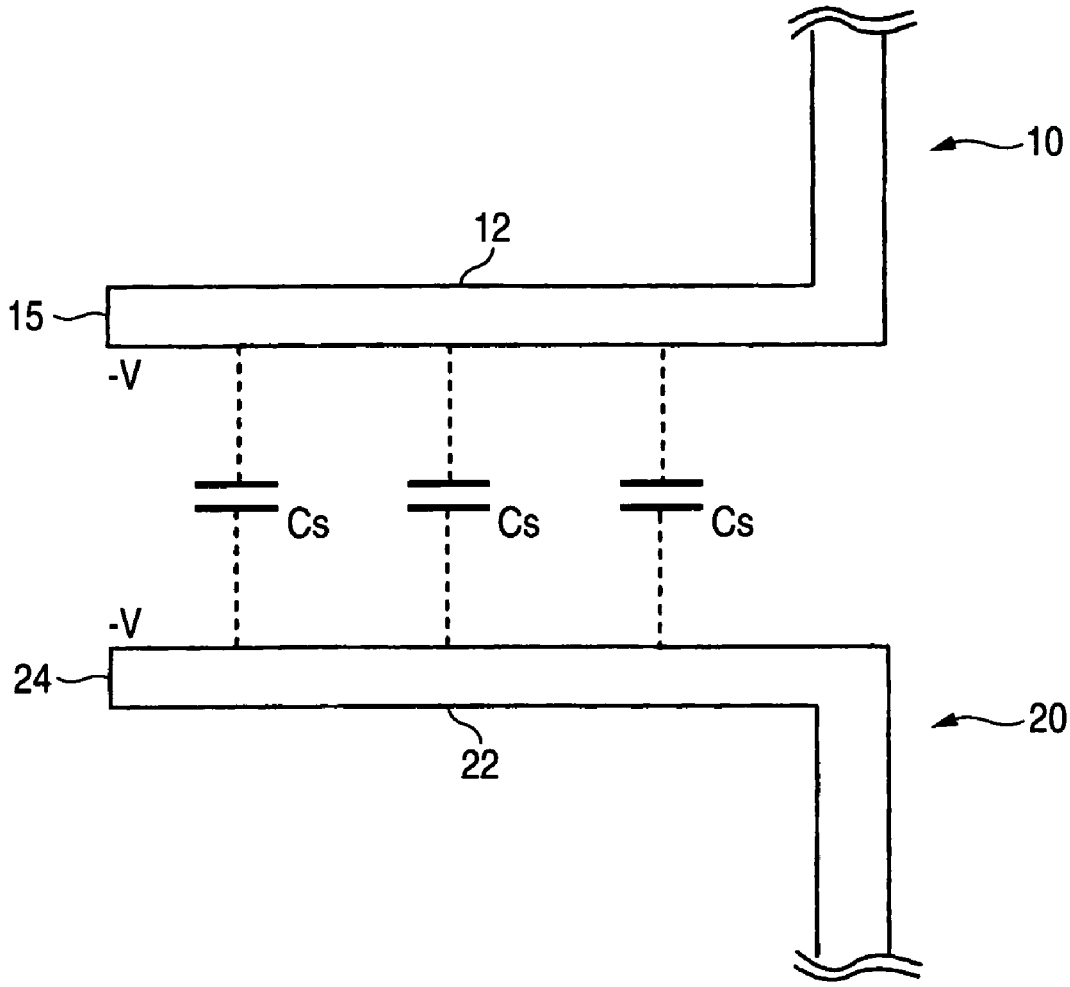
FIG. 2 is a descriptive view for describing a reduction in the influence of stray capacitance existing between substantially-C-shaped cold cathode tubes.

FIG. 2 is a descriptive view for describing the principle that the influence of stray capacitance Cs existing between the substantially-C-shaped cold-cathode tubes 10 and 20 is diminished by the cold-cathode tube driving circuit 10 of the present embodiment. As shown in FIG. 2, when the substantially-C-shaped cold-cathode tubes 10 and 20 are arranged vertically, the lower horizontal portion 12 of the cold-cathode tube 10 and the upper horizontal portion 21 of the cold-cathode tube 20 are adjacent to each other and approach each other. In the cold-cathode tubes 10 and 20 arranged as shown in FIGS. 1 and 2, the stray capacitance Cs existing between the mutually-adjacent horizontal portions 12 and 22 becomes extremely large. When the voltage appearing in the horizontal portion 12 is not in phase with the voltage appearing in the horizontal portion 22 at that time, a potential difference arises between the horizontal portions 12 and 22. When a potential difference has arisen between the horizontal portions 12 and 22, a very large leakage current flows between the horizontal portions 12 and 22, because the stray capacitance Cs is extremely large, thereby making lighting of the cold-cathode tubes 10 and 20 unstable. As shown in FIG. 2, the cold-cathode tube driving circuit 1 of the present embodiment drives, as a measure to prevent instability of lighting of the cold-cathode tubes, the cold-cathode tubes 10 and 20 such that the mutually-approaching horizontal portions 12 and 22 become in phase with each other (−V), to thus be able to prevent occurrence of a potential difference between the horizontal portions 12 and 22 as well as to flow of a leakage current between the horizontal portions 12 and 22 even when the value of the stray capacitance Cs is large. Namely, the cold-cathode tube driving circuit 1 of the present embodiment drives the cold-cathode tubes 10 and 20 such that the mutually-approaching horizontal portions 12 and 22 become in phase with each other (−V), thereby diminishing and preventing the influence of the stray capacitance Cs on lighting of the cold-cathode tubes 10 and 20. Thus, lighting of the cold-cathode tubes 10 and 20 is made stable, and occurrence of a flicker in the screen of the liquid crystal display device can be prevented.

The invention claimed is:

1. A cold-cathode tube driving circuit adapted to drive a first C-shaped cold-cathode tube and a second C-shaped cold-cathode tube, the cold-cathode tube driving circuit comprising:

a first transformer having:

a first primary winding;

a second primary winding;

a third primary winding;

a first secondary winding in which a first voltage is induced by the first primary winding, operable to apply the first voltage to one end of the first C-shaped cold-cathode tube; and a second secondary winding in which a second voltage having a polarity opposite a polarity of the first voltage is induced by the second primary winding, operable to apply the second voltage to a second end of the first C-shaped cold-cathode tube;

a second transformer having:

a fourth primary winding;

a fifth primary winding;

a sixth primary winding;

a third secondary winding in which a third voltage is induced by the fourth primary winding, operable to apply the third voltage to one end of the second C-shaped cold-cathode tube, which is adjacent to the second end of the first C-shaped cold-cathode tube; and a fourth secondary winding in which a fourth voltage having a polarity opposite a polarity of the third voltage is induced by the fifth primary winding, operable to apply the fourth voltage to a second end of the second C-shaped cold-cathode tube; and a driving circuit operable to apply driving current to the first transformer and the second transformer, wherein directions of the driving current flowing through the second primary winding and the fourth primary winding flow in opposite directions so that a phase of the second voltage is the same as a phase of the third voltage; and wherein the first, second, fourth, and fifth primary windings are connected to a drain voltage.

* * * * *